US005086827A

United States Patent [19]

Graham et al.

[11] Patent Number: 5,086,827

[45] Date of Patent: Feb. 11, 1992

[54] METHOD AND APPARATUS FOR SENSING THE CONDITION OF CASTING BELT AND BELT COATING IN A CONTINUOUS METAL CASTING MACHINE

[75] Inventors: Thomas S. Graham, Shelburne; Norman J. Bergeron, Burlington, both of Vt.

[73] Assignee: Hazelett Strip-Casting Corporation, Colchester, Vt.

[21] Appl. No.: 623,024

[22] Filed: Dec. 6, 1990

[51] Int. Cl.[5] ..... B22D 11/06; B22D 11/08; B22D 11/16

[52] U.S. Cl. ..... 164/452; 164/150; 164/154; 164/431; 164/432; 164/451; 164/481; 164/483

[58] Field of Search ..... 164/452, 451, 150, 154, 164/481, 479, 482, 483, 431, 432, 429

[56] References Cited

U.S. PATENT DOCUMENTS

| | | | |
|---|---|---|---|
| 2,904,860 | 9/1959 | Hazelett | 164/432 X |
| 3,864,973 | 2/1975 | Petry | 164/451 X |
| 4,002,197 | 1/1977 | Hazelett et al. | 164/432 X |
| 4,487,157 | 12/1984 | Bergeron et al. | 118/59 |
| 4,487,790 | 12/1984 | Bergeron et al. | 427/422 |
| 4,573,521 | 3/1986 | Artz et al. | 164/451 |
| 4,588,021 | 5/1986 | Bergeron et al. | 164/432 |
| 4,593,742 | 6/1986 | Hazelett et al. | 164/415 |
| 4,648,438 | 3/1987 | Hazelett et al. | 164/475 |
| 4,915,158 | 4/1990 | Wood | 164/431 |
| 4,921,037 | 5/1990 | Bergeron et al. | 164/432 |
| 4,926,925 | 5/1990 | Takahashi et al. | 164/154 |

*Primary Examiner*—J. Reed Batten, Jr.
*Attorney, Agent, or Firm*—Parmelee, Bollinger & Bramblett

[57] ABSTRACT

The flatness of a casting belt in a continuous metal casting machine is continuously monitored and thereby also the condition of its thermal protective coating. One or more non-contacting eddy-current sensing probes are placed in proximity to the reverse or coolant side of a belt for sensing and measuring the distance of the belt from the probe to reveal irregularities in the flatness of the belt while it travels past the probe. A deficiency of insulative belt coating can cause variations in belt flatness during casting. By monitoring such variations an operator of the continuous casting machine is alerted that the coating needs to be retouched or replaced without interrupting the casting process. Or such monitoring can alert the operator that the belt has become inherently not flat. A similar proximity sensing probe is utilized for the purpose of supplying an instant report of the initial entrance of molten metal into the casting cavity adjacent to a casting belt at the start of a cast. In this way, forward travel of the casting belt is initiated in synchronized relationship with introduction of the molten metal into the casting cavity by starting the forward belt motion at the appropriate instant before the entrained plug ("dummy bar") which is positioned between the two casting belts is moved out of position.

31 Claims, 4 Drawing Sheets

METHOD AND APPARATUS FOR SENSING THE CONDITION OF CASTING BELT AND BELT COATING IN A CONTINUOUS METAL CASTING MACHINE

BACKGROUND OF THE INVENTION

In the early prior art of continuous casting utilizing one or more tensed endless metallic belts, the commercial casting of slab or thin metal strip sometimes had to be interrupted because of poor surface of the cast product or uneven product thickness or both. Such interruptions were especially likely to occur when certain difficult metals or alloys were being cast. Several advances in methods and apparatus evolved in more recent prior art and contributed to improvements in surface characteristics and uniformity of thickness in products being cast. Some of these improvements can become optimally effective only if continual ongoing information is immediately obtained during casting relating to the state of the casting belts and their insulating coatings. Such continual ongoing immediate information has heretofore not been reliably obtainable.

A major proximate cause of defective cast metallurgy or surface flaws has been the inability of a metallic casting belt to maintain continual and continuous contact with the freezing product. Sometimes non-flatness inheres in a new casting belt. Sometimes non-flatness is due to the distortions of the belt under the thermal effects of molten metal becoming solidified. Either way, non-flatness, even a relatively small amount of non-flatness can interrupt uniform heat extraction. In consequence, zones of nearly frozen alloy may suck late-freezing constituents from less-frozen zones that have lost contact with a casting belt, resulting in a totally unacceptable metallurgical structure.

Continuously moving casting belts are naturally subjected to great and varying thermally and mechanically induced stresses as the result of their exposure on one side to freezing molten metal, while on the other side being exposed to fast-flowing cooling water. At the same time, the belts in contact with the solidifying metal must lie flat and be steered or adjusted intermittently in order to conform approximately to true endless paths around which they are desired to be revolved. The heating of one surface of a metallic casting belt by molten metal naturally tends to expand that surface, causing compressive stress on that side. Because the other side of the belt near the fast-flowing liquid coolant remains relatively cold, the heating tends to distort the belt (in the area where it follows a nominally straight course), with the hot side tending to become convex. If the heating is non-uniform, as often occurs, flutes and ripples can be caused in the belt, and these distortions disturb the belt's contact with the freezing metal product, with the unwanted results mentioned above. Approximate flatness of the course of a belt is nevertheless maintained by exerting high tension on it, but tension alone may not be a sufficient mechanical control to prevent induced distortions in the casting of some metals.

The casting belts which are employed for linear belt-type casting, as in twin-belt casting, may be made for example of mild cold-finished steel or of copper alloy as described in U.S. Pat. No. 4,915,158 of J. F. Barry Wood, which is assigned to the same assignee as the present invention. The belt thickness typically lies between 0.035 and 0.065 of an inch (0.9 mm to 1.7 mm), though the thickness may lie somewhat outside this range.

For casting slab, the belts must be relatively wide. They normally first undergo a process of roller-stretch leveling as described in C. W. Hazelett's U.S Pat. No. 2,904,860, or they are mechanically prestrained in zones as in U.S. Pat. No. 4,921,037 of N. J. Bergeron, J. F. B. Wood, and R. W. Hazelett, assigned to the same assignee as the present invention. Such pre-treatments result in an extremely flat or well-proportioned belt, suitable for all current twin-belt continuous casting purposes. However, the thinness, the long and wide dimensions, weight, and moderate yield point of such relatively wide casting belts all add up to relative fragility, such that the belt, in its ordinary handling involved in crating, shipping, and mounting on a casting machine, may yield locally and so develop subtle undulations ("loops" or "nodes") which, though they may be difficult to see, impair usefulness in service despite the usual exertion of high tension during casting, which tends to keep belts flat. It is important for a casting operator to learn of such subtle belt imperfections before attempting to cast and during casting, so that the operator can correct the situation.

The employment of thermally insulative coatings on the outside (casting side) of such belts, i.e., on the side next to the freezing metal, has proved necessary for maintaining belt flatness and desired belt surface characteristics and effects during casting and hence for maintaining high qualities in cast products. These coatings on metallic casting belts control the belt temperatures resulting from contact with molten metal on the hot side of the belt. Both solid and liquid coatings have been used, often in combination. They will be described in detail later.

Degradation of the cast product is likely to occur when the insulative coating or coatings become thin or worn, or conversely when an uneven build-up occurs in a continually applied coating.

It would seem easy to install a mechanical, directly-contacting device to sense and indicate variations in the flatness of belts as they revolve around their respective carriages in a twin-belt casting machine and travel past such a directly-contacting device. A directly-contacting device is disclosed in U.S. Pat. No. 4,002,197, assigned to the same assignee as the present invention. But in fact, wear, vibration, and sticking have prevented such directly-contacting devices from being as practical in various continuous casting installations during day-after-day operations. Through prolonged exposure to fast-moving coolant, directly-contacting devices accumulate dirt, oil, and minerals. Moreover, the high levels of sensitivity that have recently proven to be desirable for ensuring optimum casting have unexpectedly rendered contact-type mechanical devices relatively marginal in their performance. Further, there has been difficulty of access to such directly-contacting devices for providing maintenance to them, because they were located among numerous closely-spaced backup rollers, nozzles, and gutters.

The present invention solves, or substantially overcomes, these problems of the prior art.

SUMMARY OF THE INVENTION

Described are a method and apparatus for continually sensing flatness of a casting belt of a continuous casting machine before a cast and moreover for continuously sensing and monitoring flatness of the belt during casting and in such a way, and with such precision, as to supply continual ongoing immediate and sufficient information concerning the belt proper and its insulative coating for enabling optimization of belt conditions and characteristics during continuous casting. The continual ongoing immediate information which is provided enables line personnel to take steps while casting to adjust for any adverse conditions so as to forestall changes for retaining continuity of the cast and for achieving uniform high quality in the cast product. Such adjustments are often accomplished by selectively touching up the non-permanent, temporary "topcoat" if any, or else by replacing a topcoat to ensure its uniformity.

Moreover, the invention greatly facilitates trying-out various changes in belt coatings and techniques and in determining their results for the establishment of belt-coating specifications when casting previously untried alloys.

Such adjustments or try-outs of new belt-coating procedures may be accomplished without stopping a cast that is in progress. That is, adjustments and try-outs advantageously may be made "on the fly."

The present invention employs one or more movable or fixed electrical distance-sensing sensors called "proximity probes," which are non-contacting but are positioned near to the belt, together with the required electrical powering and reading equipment. Such a distance-sensing transducing probe senses precisely the nearby position of a belt surface with respect to the plane of the pass line of the freezing product. In the illustrative embodiment of this invention, a distance-sensing transducing probe is mounted near the upstream part of the casting region near the coolant-cooled surface of a revolving casting belt. Thus, the position of the belt is sensed in relation to the plane of the pass line to determine on a continual, ongoing and immediate manner whether the casting belt (as it travels past this proximity probe) is in continuous intimate contact with the pass line of the freezing product as desired. A plot of the actual belt deflection versus time is readily displayed on a computer screen of strip-chart recorder.

Among the advantages of the present invention are those resulting from the fact that it involves no mechanical contact with the revolving casting belt. Hence, there is no disturbance or wear of the probe nor of the revolving belt. Unlike apparatus of the prior art, there is nothing to wear out, nor vibrate, nor clog nor stick. Moreover, a proximity probe causes little or no disturbance to the free-flow of cooling water along the belt surface.

We have discovered another application for apparatus as described herein. In the start of pouring of (for instance) steel into a belt-type casting machine, difficulty may be experienced in ascertaining the precise moment at which molten steel first contacts the belt. This immediate initial information is important in order that the revolution of the belt or belts of the casting machine may be started at just the appropriate moment, without prematurely disturbing an initially present plug—i.e., a dummy bar and any metallic shavings that may have been inserted into the casting cavity of the machine near the dummy bar to protect the belt or belts from the speed and heat of the initially fast-spreading molten metal.

BRIEF DESCRIPTION OF THE DRAWINGS

Other objects, aspects, features and advantages of the present invention will be apparent from the following detailed description of the presently preferred embodiments considered in conjunction with the accompanying drawings, which are presented as illustrative and are not intended to limit the invention. Corresponding reference numbers are used to indicate like components or elements throughout the various Figures.

FIG. 3 also shows a portion of an upstream main roll and two casting belts with a "dummy bar" between them as positioned at the start of a cast.

DESCRIPTION OF THE PREFERRED EMBODIMENT

Figure 1:
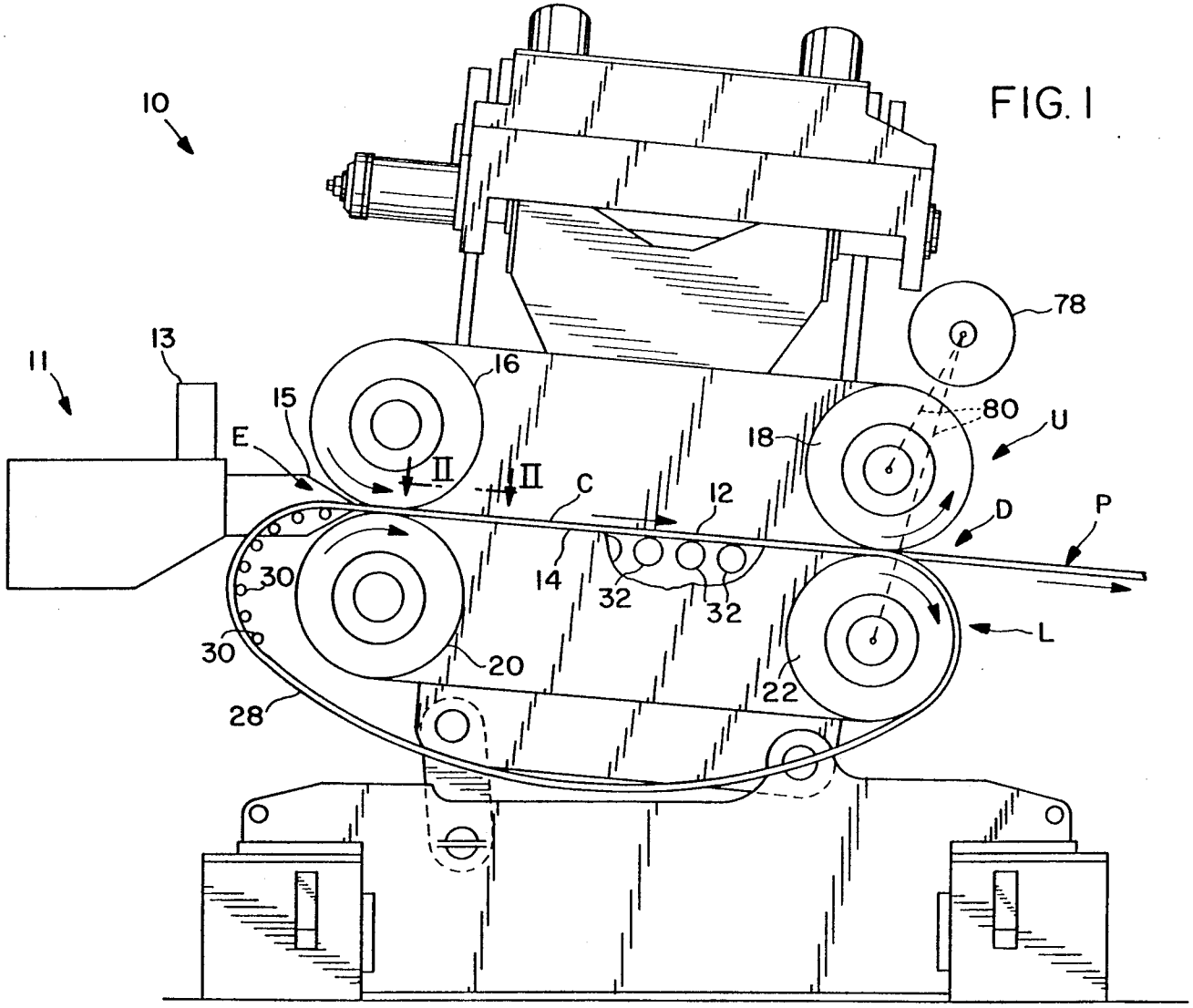
FIG. 1 is a side elevation view of a twin-belt continuous metal-casting machine, which is an illustrative example of a belt-type continuous metal-casting machine in which the present improvement may be employed to advantage.

Referring now to FIG. 1, a belt type of continuous casting machine, illustratively shown as a twin-belt caster, has molten metal fed into the entry end E between upper and lower casting belts 12 and 14.

Figure 3:
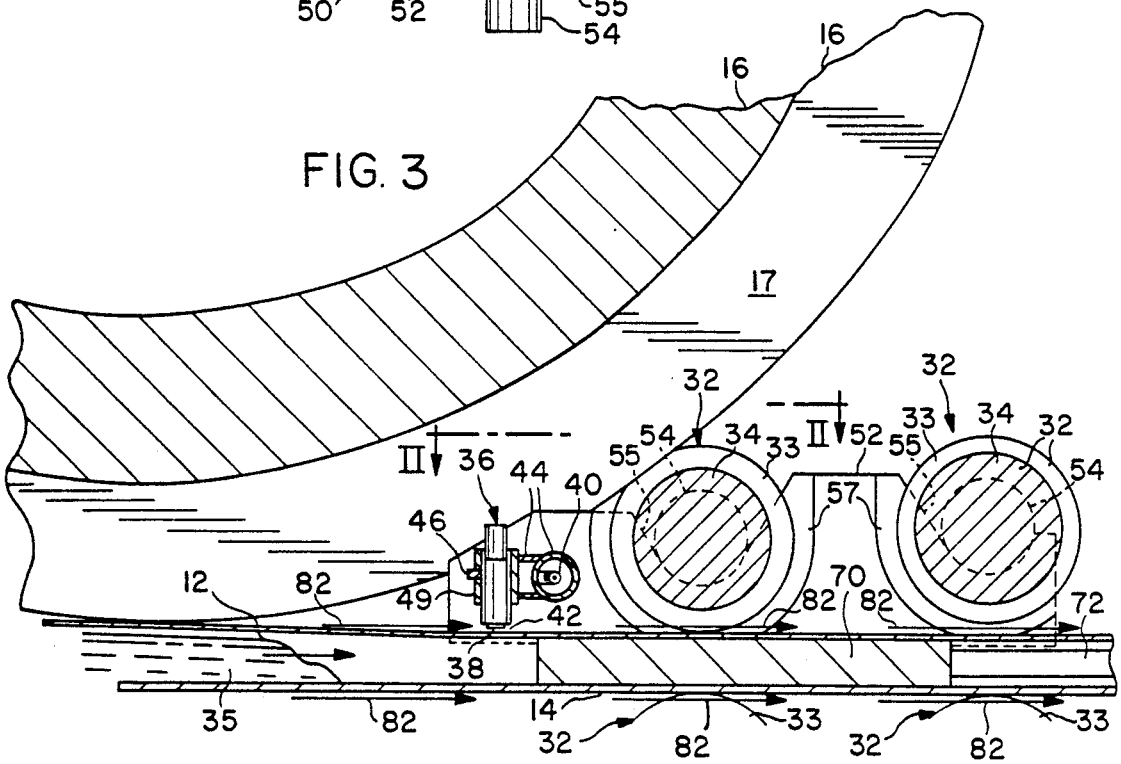
FIG. 3 is a cross-sectional detail of a proximity-sensing probe and its supports as seen taken along the line III—III in FIG. 2.

The molten metal is supplied from in-feed apparatus, generally indicated at 11, and the flow-rate of the molten metal into the machine is controlled by an in-feed flow controller 13, for example such as a movable gate (or stopper) associated with the tundish and its nozzle 15 which directs the molten metal into the entry E. Cast metal product P issues from the downstream or discharge end D of the machine 10. The casting belts 12 and 14 define between them a moving casting cavity C and are supported and driven by means of upper and lower carriage assemblies U and L respectively. The upper carriage U, as shown in this embodiment of the present invention, includes two main roll-shaped pulleys 16 and 18 around which the upper casting belt 12 is revolved as indicated by the curved arrows. The pulley 16 near the input end E of the machine is provided with multiple circumferential fins 17 (only one fin is seen in FIG. 3) and is referred to as the upstream pulley or nip pulley, and the other pulley 18 near the discharge end D is called the downstream or tension pulley. Similarly, the lower carriage L, in the embodiment of the invention as shown, includes main upstream (or nip) and downstream roll-like pulleys 20 and 22 respectively, around which the lower casting belt 14 is revolved (as indicated by the curved arrows).

In order to drive the casting belts 12 and 14 in unison, pulleys 16 and 20, or 18 and 22 of both the upper and lower carriages are jointly driven at the same rotational speed through universal-coupling-connected drive shafts (not shown), by a mechanically synchronized drive (not shown). Two laterally spaced edge dams 28 (only one edge dam is shown in FIG. 1) travel around rollers 30 to enter the moving casting region C, defined between the casting belts 12 and 14. Typically, a multiplicity of backup rollers 32 (FIG. 1) each including fins 33 and a core 34 (FIGS. 2 and 3) restrain the casting belts 12 and 14 against the pressure of molten metal 35 and define the position of the belts during casting, doing so while permitting the free passage of coolant 82 traveling longitudinally past the fins 33. It is to be understood that the belt position may also be defined by sliding fins or by protrusions on stationary platens or by hydrodynamic devices.

Figure 2:
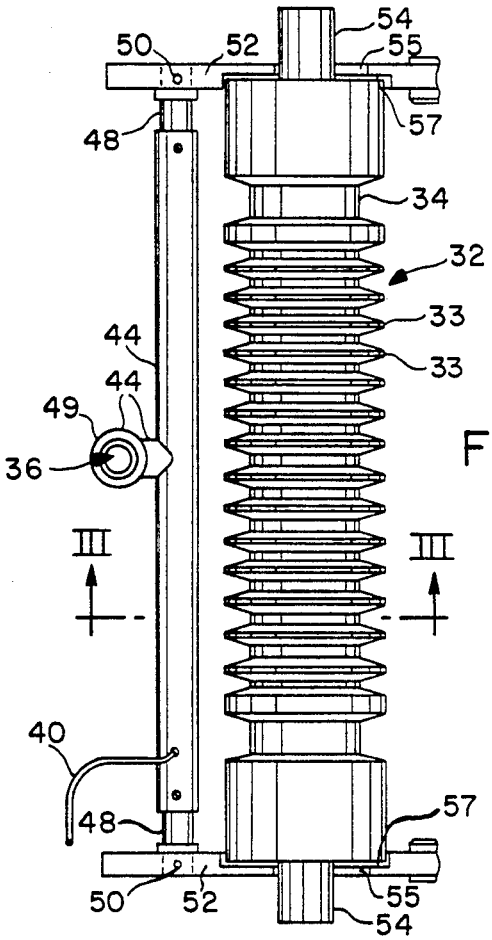
FIG. 2 is an enlarged plan view showing a proximity probe and its support as seen from the viewing position II—II in FIGS. 1 and 3.

In carrying out the present invention in its preferred mode, a small position-sensing probe (proximity probe) 36 is employed, as illustrated in FIGS. 2 and 3. This probe includes a coil of fine wire (not shown) with its axis generally perpendicular to the surface of the object of measurement—in this case the upper casting belt 12. It is our present understanding of the operation of this proximity probe 36 that it works on an eddy-current principle, whereby the coil in the probe 36, which is energized by an alternating-current (AC) power supply 37 on a remotely-located electronic measurement unit 39, induces eddy currents in its object of measurement, namely, in the metallic belt 12, which is electrically conductive and whose distance from the probe 36 is being sensed and measured. The eddy currents so induced absorb energy from the probe. These eddy currents produce reflexively a decrease in impedance of the coil in the proximity probe or, in another way of speaking, produce an increase in the current through the proximity probe coil from what it would have been without the presence of the belt 12. The closer the belt 12 is to the probe 36 the greater the decrease in impedance in the coil.

Through a coaxial cable 40 the probe 36 cooperates with the remotely placed electronic measurement equipment 37, 39 that energizes the probe coil and electronically amplifies and analyzes its output signal.

A typically used proximity probe 36 and its associated electronic equipment 37, 39 was obtained from the company named Bently Nevada, having offices in Minden, Nev., and called their "7200 Series 11 mm Proximity Transducer System." This probe is small enough to fit unobtrusively into a twin-belt continuous casting machine. The measured results are recorded by means of a readout device such as a chart recorder 41 and simultaneously can be viewed by the operator on a cathode-ray tube monitor 43. Most conveniently, the measured data resulting from the proximity probe 36 is also displayed as part of a general data collection system in a control panel 45 that draws, displays and records information also on temperatures, speeds, speed ratios, and torques.

This system 36, 37, 39, 40 accurately measures the distance of the metallic belt 12 from the face 38 of the probe 36 without need for contact of this face 38 against the belt 12 and with practically instant response. The farther the working face 38 of such a probe 36 is from the belt 12, the less the eddy-current energy loss. This energy loss is detected by the measuring equipment 37, 39 to result in a directly useful output signal. Within practicable limits, such a proximity probe 36 and associated equipment 37, 39, 40 in a system as shown provides surprisingly linear measurements. In our experience, a proximity sensing and measuring system as shown will indicate a change in distance of the belt 12 from the probe face 38 as small as 0.0005 of an inch (½ mil or 13 micro-meters)—more than sufficient for present purposes.

It is to be understood that there is a similar proximity probe and measuring system (not shown) associated with the lower belt 14. Also, it is to be understood that a plurality of such proximity sensor probes may be employed for sensing each belt.

Such a probe 36 is mounted in the casting machine 10 at a predetermined spacing (gap) 42 normally of about ⅛ inch (3 mm) from each of the belts 12 and 14 on the coolant side or inside, as shown for the upper belt 12 in FIG. 3. This gap 42 could be fixed anywhere within the range of about 0.08 of an inch (2 mm) to 0.40 of an inch (10 mm), the higher end of this range being accessible to a larger, farther-reaching proximity probe 36. This predetermined spacing (gap) 42 allows clearance for the fast-flowing coolant 82 next to the casting belt without significantly disturbing the coolant flow. In an upstream/downstream (longitudinal) sense this probe 36 is placed near the mold entrance E, preferably being positioned within a longitudinal zone of about ten inches (254 mm) downstream from (i.e., to the right of) a point F of first contact of molten metal with the casting belt. This longitudinal zone X is the zone in which is desired to be initiated the freezing of a film of metal against the mold side of the belt 12 or 14.

The proximity probe 36 is shown mounted on a welded tubular frame 44 that stretches across the carriage U or L in which it is mounted. Setscrew 46 secures the probe 36 in a socket 49 secured to the mounting frame 44. The frame 44 is supported by flanged studs 48 which are secured by pins 50 in sockets in yokes 52 near the ends of the frame 44. The whole mounted assembly is located in the carriage U or L of the casting machine by the straddling of the yokes 52 against backup-roller pivot shafts 54. As seen in FIG. 3, the yokes 52 have two rounded V-shaped seats 55 which serve to capture the backup roller pivot shafts 54 for conveniently and precisely holding the mounted probe 36 in its desired position relative to the belt 12, because the nearby backup rollers 32 are defining the desired plane of travel of the casting belt 12. In other words, the yokes 52 are being positioned by means of the backup-roller pivot shafts 54 which are simultaneously positioning these rollers and hence are defining the desired path of travel of the belt 12. There are generally U-shaped clearance reliefs 57 formed in the inside surfaces of the yokes 52 so as to provide clearance for the ends of the respective backup rollers 32. Alternatively, the probe 36 may be mounted using other methods or mounted in other parts of the casting machine structure.

Figure 4:
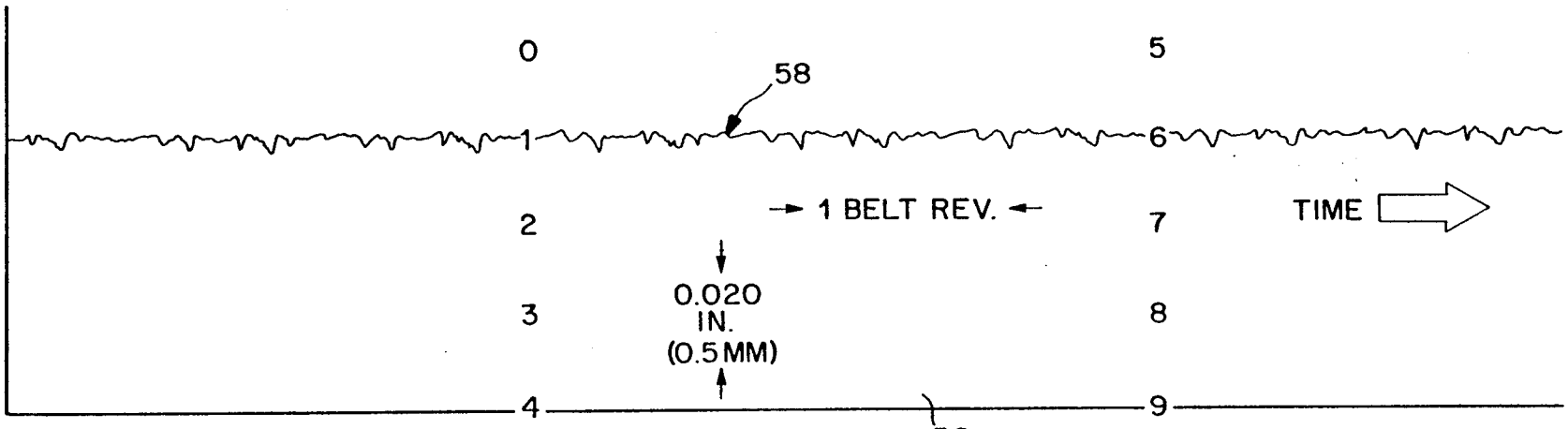
FIG. 4 is a chart recording of the contour of a flat and properly coated casting belt as it repeatedly passes a proximity sensor installed as shown in FIGS. 2 and 3 for molten aluminum being satisfactorily cast.
Figure 5:
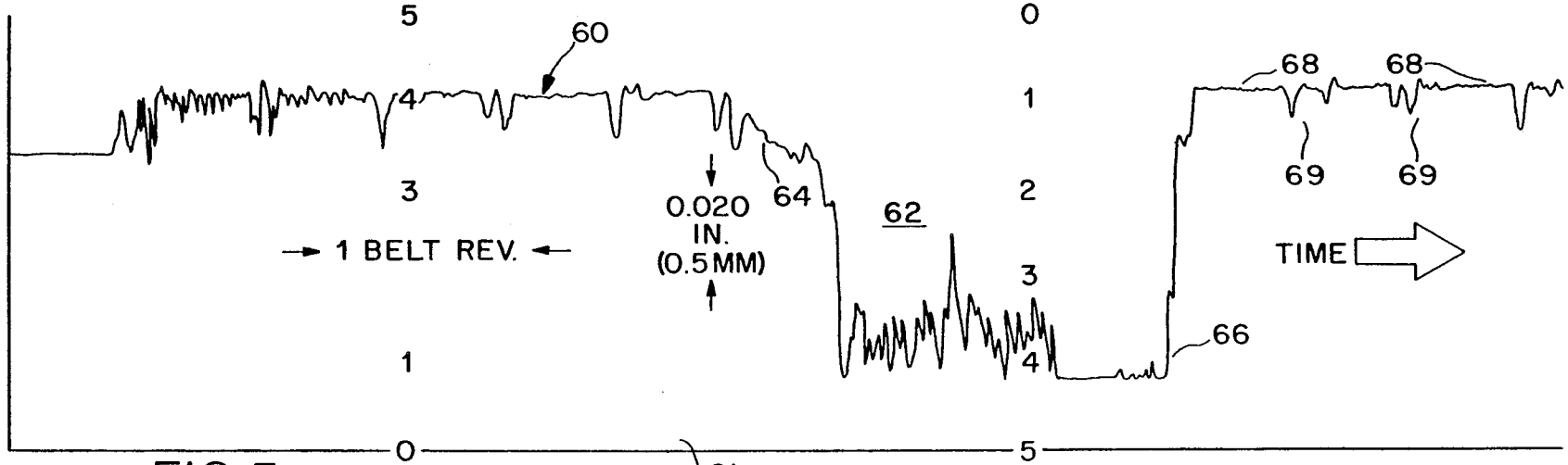
FIG. 5 is a chart recording made under conditions similar to FIG. 4 but illustrating a repair of insulative belt coating being made "on the fly," i.e., while a continuous casting operation is being carried on without interruption. This belt happens to have slight inherent kinks causing indications which appear repetitively on this chart in FIG. 5.

Typical chart records are shown in FIGS. 4 and 5. If there is no fluctuation in the reading, and if the belts lie against smoothly running, undeflected backup rollers, the mold surface of the belt 12 is the same as the upper boundary of the casting "pass line" by definition. In our experiments, the presence of flowing coolant water 82 does not adversely affect the measured response of the proximity probe 36, except that materials in the coolant water, presumably mainly salts or ions which render the water conductive may, with some equipment designs, cause a steady "offset" that has been measured as 4 to 6 mils (0.1 to 0.15 mm) in the reading. That is, the gap 42 may appear smaller by the amount of this offset than it actually is. The cooling water used in these experiments would pass standards for potable water so far as salts were concerned. There appears to be no reason why this correction might not at times need to be substantially greater or less than the range just stated, but no further data have been gathered.

We have discovered that, under some conditions as measured during casting, particularly in casting aluminum having low alloy content, that a casting belt may deviate up to 0.010 of an inch (0.25 mm) in one direction from the desired pass-line relationship without causing undesired degradation of the cast product P. However, at other times, deviations as small as 0.005 of an inch (0.13 mm) can cause problems, notably in casting an aluminum alloy of wide freezing range, for example, one containing about 2.5 per cent or more of magnesium—as a specific example, AA 5052 alloy in the nomenclature of the Aluminum Association. The deviations from flatness just mentioned are nearly always in an outward direction, toward the pass line. The casting results of employing the present invention involving proximity measurements are especially striking and advantageous in continuous casting of such long-freezing range alloys, since such small deviations of flatness as are associated with degradation in casting 5052 alloy are indicated and can be adjusted and compensated for or overcome.

The inherent flatness of the casting belt—its freedom from nodes, loops, or kinks—can be measured initially when no metal is being cast. If the inherent unflatness of the belt at any point is more than deemed suitable for the alloy to be cast, such as 0.010 of an inch as discussed right above, then the belt is thereby indicated as a candidate to be leveled or re-leveled or mechanically prestrained, employing notably such a procedure as referred to in the above background.

Later on, during casting, a belt which has passed such a preliminary measurement test may nevertheless produce measured indications that its desired unflatness limits have become exceeded due to the effects of heat in combination with worn coating, usually a worn temporary "topcoat."

An important feature of the present invention is the detection of defects in belts newly mounted on the casting machine. The typical defect is a transverse kink, which we refer to as a "node." Nodes result from rough handling of these long, wide, limp belts during shipment or during placement on the casting machine, or from crates that do not support the insides of the belts during shipment. We measure the height or depth of these nodes while the belt is revolving on the casting machine 10 under a normal operating tension of 10,000 pounds per square inch (700 kilograms per square centimeter) or somewhat more. Under this condition, a node that measures less than 0.008 of an inch (0.2 mm) from the passline is considered to be a low-height node and is deemed acceptable for casting. A node of this low height or depth will almost always decrease during revolving travel of a belt while the belt is being employed for casting. On the other hand, a node greater than 0.008 of an inch will almost always increase in amplitude while a cast proceeds, and the belt will become unusable after a node height of about 0.010 of an inch is reached, because the slab P usually thereafter becomes unacceptable. The proximity probe readings taken during casting reliably indicate when to abort such a cast.

Before starting a cast, non-permanent (temporary) insulative coatings or parting compounds ("topcoats") are usually applied over a permanent insulative coating, as known in the art. Such an additional or temporary coating may be an oil such as polyalkylene glycol or silicone fluid. In the casting of aluminum, a film of soot (finely divided amorphous carbon) or diatomaceous silica, or both, together with binder and alcohol/water carrier, are more usually applied as a topcoat. Application of the topcoat, if any, is usually done before the start of a cast, with re-application or touch-up being carried out during casting as required.

The permanent insulative coating layer next to the belt is normally provided according to U.S. Pat. Nos. 4,487,157, 4,487,790, and 4,588,021 (previously referenced) which are assigned to the same assignee as the present invention. Such a permanent insulative coating is normally not reapplied to a belt.

FIGS. 4 and 5 show portions of the recordings of measurements made during actual casts of aluminum having 2.8 percent magnesium content. The relative smoothness of the recorded measurement line 58 on a chart 59 in FIG. 4 bears witness to a normal, untroubled period of casting. It is seen that the measurement record line 58 shows total overall changes in the spacing gap 42 of no more than about 0.005 of an inch (0.12 mm). The belt was inherently flat and the insulative coating was sufficient. On the charts 59 and 61 in FIGS. 4 and 5, respectively, a horizontal distance of about seven spaces equals one full revolution of a belt, and a vertical distance of two spaces indicates a change in gap space 42 (FIG. 3) of 0.020 of an inch (0.5 mm). A downward movement of recorded measurement lines 58 and 60, on charts 59 and 61 respectively, indicates an increase in the gap space 42, i.e., an inward deflection of the belt toward the casting cavity C.

At the left of FIG. 5, a measurement record line 60 illustrates the effect of a "topcoat" coating that has worn thin. The operator decided at about location 64 that it was time to remove the old, unevenly worn topcoat of binder, soot and diatomaceous silica so as to apply a renewed topcoat coating. Hence the relatively wide "valley" 62 appearing in the recorded measurement line in FIG. 5, reflecting the time period of about two full belt revolutions, during which time hand scouring with steel wool had, to a certain extent, removed the temporary topcoat insulative coating. The valley 62 represents the inward movement of the belt (toward the freezing metal) of an amount up to about 0.060 of an inch (1.5 mm) due in this case to heating effects of the metal being cast. During this time 62, the casting was of poor quality. Then the operator sprayed a new topcoat coating of binder, soot and silica onto the belt; this renewed topcoat coating entered the mold at about point 66. All this renewal of the topcoat coating was done quickly without interrupting the casting process, as FIG. 5 records, where the operation was accomplished in about two belt revolutions. Naturally, the material that is cast during such a repair operation "on the fly" is scrapped and remelted, a procedure normally less costly than stopping and re-starting the cast. Such coating adjustment, where possible, is usually done at the beginning or end of a coil of cast material P in order to avoid interrupting the manufacturing of full coils of rolled-down strip by the rolling mill downstream (not shown) and the coiler farther downstream (not shown). The cast product after rolling in line, is being coiled downstream.

The record line in FIG. 5 in area 66 after the recoating (to the right of the valley 62) reveals less irregularity, indicating that casting conditions had been improved to an acceptable level. However, two persistent, repetitive peaks 68 appear to remain at regular intervals, each corresponding, respectively, with the time required for a full belt revolution. These peaks 69 evidently were caused by areas with particular coating deficiency which then required touch-up work.

Narrow peaks may be caused by a slight kink or by a weld that was not quite smooth, either of which may activate the probe every revolution of the belt. Similarly, the probe senses dimples and bumps in the belt. All such data is highly useful. But the point here is that the proximity probe 36 senses something else, namely, the worn, unduly thin or absent condition of the temporary topcoat insulative soot-and-silica coating (or other temporary parting-agent coating) such as that indicated in the recorded line 60 to the commencement at 64 of the scouring process. The slow deterioration of a topcoat.temporary coating can be observed as the deterioration gradually develops. Corrective action may then be planned to be taken prior to the starting of the winding of the next coil of rolled product downstream. There are provided immediate ongoing indications of the resulting indeterminate, heat-activated, fluctuating positions of the belt which are inconsistent with good cast product in certain alloys and of which the operator needs to be made directly aware at the earliest possible time.

The speed of the casts whose measurements were recorded in FIGS. 4 and 5 was about 35 feet (10.6 meters) per minute. In the chart recordings 58 and 60, time is increasing toward the right in the direction of the "TIME" arrows. In order to enable the showing of recorded measurement lines 58 and 60 corresponding to at least about seven belt revolutions, the horizontal dimensions of an actual chart recording have been reduced by more than one hundred to one, while the vertical dimensions of the chart have been increased for clarity of illustration by a factor of more than ten to one; consequently there are exaggerations of the slope of the profile of the recorded measurement lines 58 and 60 in FIGS. 4 and 5 by more than three orders of magnitude.

Fluting distortions of a belt are revealed by the present invention. Such fluting distortions can result from insufficient belt preheating, such pre-heating being described in U.S. Pat. No. 4,002,197, assigned to the same assignee as the present invention.

In a twin-belt casting machine, it is desirable to monitor both upper and lower belts 12 and 14, or both belts of a vertical twin-belt caster. FIGS. 4 and 5 were made with a probe 36 positioned in longitudinal alignment with the middle of a 15-inch slab being cast. However, distortion is not necessarily maximized at the middle. The optimal mode for all but very narrow casting machines now appears to be to display on one common chart and/or one common cathode-ray tube the signals resulting from each of two or three probes each placed at the same downstream distance X from the point F of first contact of molten metal with the belt. These two or three probes are uniformly spaced laterally across the width of the casting cavity C. The one or two additional probes are not shown in the drawings herewith but are similar to the first probe. Alternatively, one transversely movable probe (not shown) can be used, which can be moved laterally so as to cover the entire width of the casting cavity C.

The density (specific gravity) of metals to be cast is relevant. A lighter metal of relatively lower specific gravity, for example aluminum, will not press and flatten the belts against the backup rollers 32 or other backup means with the same consistency as occurs with a heavier metal, for example zinc or copper. Hence, the present invention is very well suited for use in casting aluminum and other light metals, though use of this invention is not at all limited to the continuous casting of lighter metals.

In another aspect of the present invention, a proximity probe 36 may detect the first inrush of liquid metal 35 into a casting machine 10. This inrush is normally initially confined to the upstream portion of the machine by a dummy bar 70 extending across the full width of the casting region C, with a downstream handle 72 attached. The dummy bar is a plug that prevents liquid metal from flowing through the machine without being consolidated into a freezing slab or bar of metal. In the startup phase of the continuous casting of steel, the dummy bar 70 also acts as a retainer for steel chips or shavings positioned in the mold cavity upstream from the bar 70. These chips serve to slow and cool the inrush of molten steel, thereby protecting the belts from undue temporary heat warping and thus forestalling leakage at either side of the machine past the edge dams 28. When the belts of a twin-belt casting machine are started in motion, the dummy bar 70 is carried downstream with the belts. If the dummy bar starts moving too early, then its purpose is defeated. If it starts moving too late, then overpouring, or flashing back of molten metal past a tip of a pouring nozzle 15 may occur. Such overpouring problems are avoided by starting the downstream motion of the casting belts within about three seconds after molten aluminum strikes a belt, or normally right at the moment when molten steel strikes the belts. These considerations are critical in achieving a successful startup in steel casting.

Figure 6:
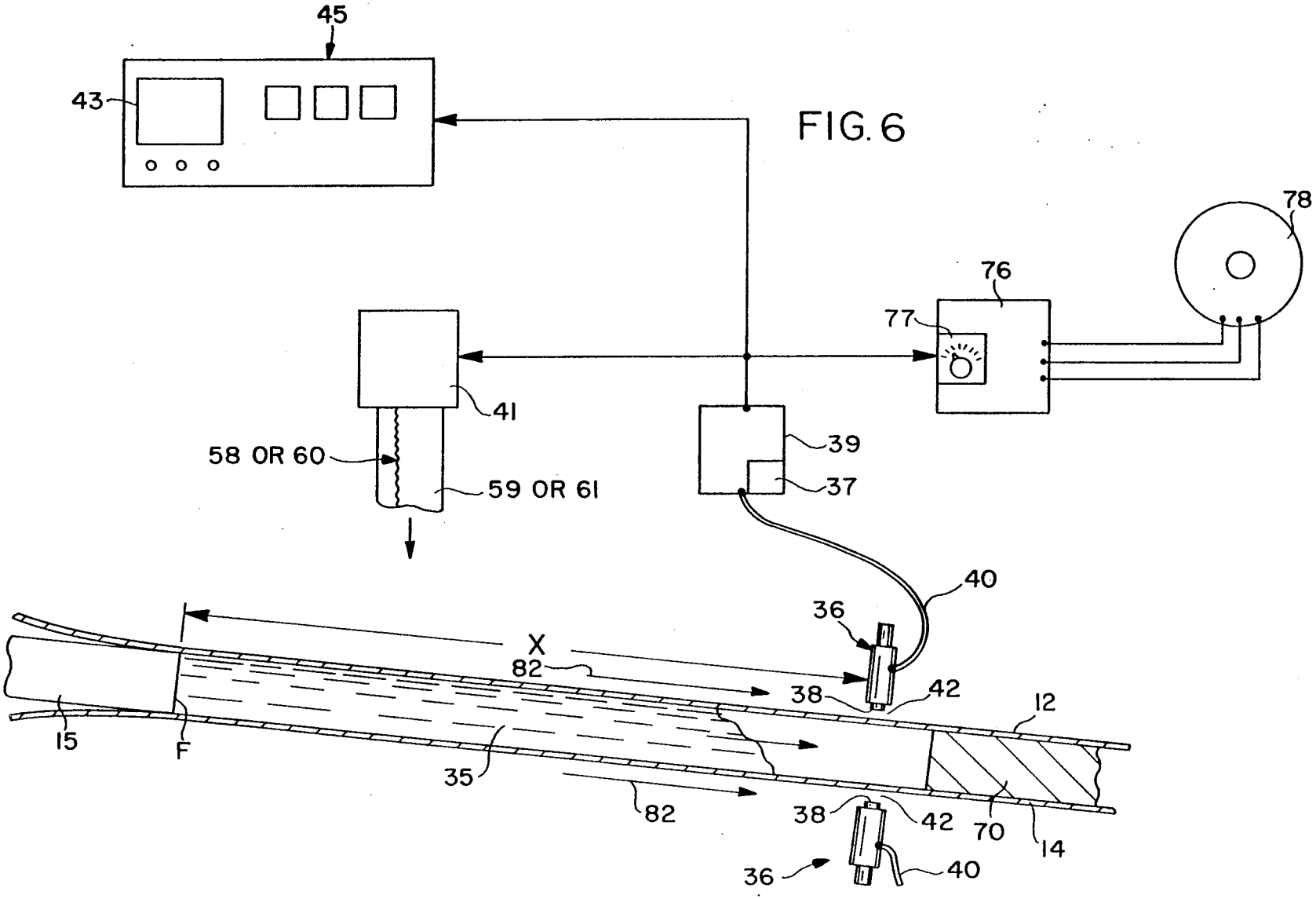
FIG. 6 is a schematic electrical diagram showing an embodiment of the present invention for automatically starting-up the belt drive at an appropriate instant in response to the initial introduction of molten metal 35 into the upstream end of the casting cavity.

This timing of starting the downstream motion of the casting belts 12 and 14 is accomplished as will now be described. Where the molten metal initially touches the casting belts, a belt warps elastically toward the molten metal a distance on the order of 0.005 to 0.020 of an inch (127 to 508 micro-meters). Within limits, this initial deflection in itself is harmless. The present proximity sensing system immediately indicates this initial inward warp (deflection) as a sudden increase in the gap space 42, thereby immediately indicating that the belts should be started into motion. For this start-up indicating purpose, the sensor 36 should ordinarily be placed at about the distance X downstream from the discharge end of the metal-feeding nozzle 15 at F—that is, near the upstream end of the mold cavity. This start-up signal may advantageously be tied into the drive control circuit for automatic belt-drive starting as shown in FIG. 6. In FIG. 6 is indicated at 76 the start-up control for the electrical motor drive 78 connected through a drive train 80 to the downstream drive pulleys 18 and 22 for the casting belts 12 and 14. The electronic measurement unit 37, 39 is turned on by the operator just prior to the introduction of the molten metal, and the start-up control 76 is connected to the measurement unit 37, 39 and is arranged to respond to the first signal indicating that a belt deflection of at least 0.005 of an inch is occurring. This start-up control 76 has an adjustable time-delay setting 77, in the range from zero to four seconds for accommodating various metals and alloys.

FURTHER THEORY AS TO WHY THIS INVENTION WORKS TO ADVANTAGE

The immediate ongoing and relatively precise measurements provided by the present invention have now revealed how very sensitive a continuous belt-type casting process is to what were formerly regarded as minor imperfections in casting belts, at least when certain alloys are being cast. How should the extreme sensitivity of casting quality to belt stability—i.e., flatness—be explained? We will present our current theory. It was noted above that long-freezing-range alloys, notably high-magnesium alloys such as AA 5052, are highly sensitive to lack of belt flatness and stability. Such long-freezing-range alloys remain mushy and friable until they are completely frozen, since the mush is like a mix of particulate sand and water. The "particulate sand" is the higher-melting, earlier-freezing alloying combinations, and the "water" is low-melting-point liquid, tending toward a eutectic mixture. It appears that the friability of the AA 5052 aluminum alloy gives rise to fissures and bleeding when a belt warps thermally, a situation that permits bleeding of low-melting-point liquid, thereby bringing molten metal into close localized contact with the belt and so giving rise to still further loss of belt stability. Alloy AA 3004 has a smaller freezing range than AA 5052 but behaves much the same in this respect.

It is known that metals that are more nearly pure such as aluminum alloy AA 1070 are stronger and less friable when hot than an alloy such as AA 5052. The more nearly pure alloys set up solid relatively soon as they cool. Assume that in casting an AA 1070 alloy a probe is installed near an inherently flat belt at a point downstream from the place where a shell of metal is frozen hard, even a thin shell. The probe will detect little or no belt unevenness, even given a defective belt coating; only background noise such as backup roller "runout" will be detected. We believe that the thin, initially frozen shell of AA 1070 alloy is strong enough, yet flexible enough, to accomodate itself to the leveling out of the belt as the heat flux or rate of heat transfer drops, which drop naturally occurs as the 1070 product proceeds downstream in the casting machine.

Though this explanation of the difference between the behavior of various alloys represents merely our current theoretical explanation to date, we affirm that the present invention can be employed to significant advantage in casting various metals and their alloys.

CONCLUSION

The proximity sensing measuring system apparatus described herein is a valuable trouble-shooting or diagnostic tool when used in the methods described. When multiple proximity probes 36 are deployed across or along a moving belt, they reveal its shape. The pattern of the readings helps to pinpoint the causes of slab defects—for instance, thinning of belt coating, insufficient belt preheating, and interaction of these factors with various alloys, nodes, loops, or kinks in the belt, etc.

Although the examples and observations stated herein have been the results of experimental work with a limited number of molten metals and alloys, this invention appears applicable to the continuous casting of any metal.

Although specific presently preferred embodiments of the invention have been disclosed herein in detail, it is to be understood that these examples of the invention have been described for purposes of illustration. This disclosure is not to be construed as limiting the scope of the invention, since the described methods and apparatus may be changed in details by those skilled in the art, in order to adapt these systems and methods for sensing the conditions and characteristics of casting belts and their thermally insulative coatings, if any, so as to be useful in various particular belt-type continuous casting machines or various belt-type caster installation situations, without departing from the scope of the following claims.

We claim:

1. In the continuous casting of metal product from molten metal employing a moving mold including at least one revolving, tensed, flexible, electrically-conductive metallic casting belt having a front face defining a portion of the moving mold and having a predetermined desired "pass line" position, and said casting belt having a back face cooled by aqueous coolant applied to said back face in the vicinity of said moving mold, the method of monitoring status of the front face of the revolving casting belt during continuous casting comprising the steps of:

positioning a proximity sensor in predetermined spaced relationship relative to said back face of the revolving casting belt during continuous casting, said proximity sensor being positioned in a region opposite to said portion of the moving mold, said proximity sensor being positioned at a predetermined distance from said desired "pass line" position of the front face of the revolving casting belt, using the proximity sensor for sensing the spacing between the back face of the revolving casting belt and said proximity sensor, and from the sensed spacing between the back face of the revolving casting belt and said proximity sensor determining deviation of the front face of the revolving casting belt relative to said predetermined "pass line".

2. The method claimed in claim 1, characterized in that:

said front face of said casting belt bears a thermally insulative coating, and wherein:

said deviation of the front face of the revolving casting belt is used for determining status of said insulative coating on said front face.

3. The method claimed in claim 1, further characterized by the steps of:

predetermining a maximum acceptable value for said deviation, and upon exceeding said maximum acceptable value refurbishing the insulative coating on the revolving casting belt while continuing to perform the continuous casting.

4. The method claimed in claim 1, characterized by the steps of:

immersing at least part of said proximity sensor in said aqueous coolant, and in using the proximity sensor for said step of sensing the spacing between the back face and said proximity sensor making an allowance for effects of said aqueous coolant and any materials therein, such effects causing said spacing to seem smaller than actual spacing.

5. The method claimed in claim 3, characterized by the steps of:

immersing at least part of said proximity sensor in said aqueous coolant, and in using the proximity sensor for said step of sensing the spacing between the back face and said proximity sensor making an allowance for effects of said aqueous coolant and any materials therein, such effects causing said spacing to seem smaller than actual spacing.

6. The method claimed in claim 1, wherein:

said proximity sensor is positioned in a predetermined spaced relationship in the range of about 0.08 of an inch to about 0.40 of an inch (about 2 mm to about 10.2 mm) from said back face.

7. The method claimed in claim 3, wherein:

said proximity sensor is positioned in a predetermined spaced relationship in the range of about 0.08 of an inch to about 0.40 of an inch (about 2 mm to about 10.2 mm) from said back face.

8. The method claimed in claim 4, further characterized by:

making an allowance for electrical conductivity effects of said aqueous coolant and any materials therein.

9. The method claimed in claim 4, further characterized by the steps of:

positioning said proximity sensor at a predetermined actual spacing from said back face in the range of about 0.08 of an inch (about 2 mm) to about 0.40 of an inch (about 10.2 mm), and making an allowance for the electrical conductivity effects of said aqueous coolant and any materials therein, said allowance being in the range from about 0.004 of an inch (about 0.1 mm) to about 0.006 of an inch (about 0.15 mm).

10. The method claimed in claim 1, wherein molten metal being introduced into the moving mold initially comes into thermally conductive relationship with said front face at a point of first contact and wherein said proximity sensor comprises an eddy-current type of sensor, characterized further by the step of:

positioning said eddy-current type of proximity sensor at a point within a range of distance "X" from said point of first contact, said range of distance X being measured in the downstream direction of motion of said moving mold, and said range of distance X being no more than about 10 inches (about 254 mm).

11. The method claimed in claim 2, wherein molten metal being introduced into the moving mold initially comes into contact with said thermally insulative coating at a point of first contact and wherein said proximity sensor comprises an eddy-current type of sensor, characterized further by the step of:

positioning said eddy-current type of proximity sensor at a point within a range of distance "X" from said point of first contact, said range of distance X being measured in the downstream direction of motion of said moving mold, and said range of distance X being no more than about 10 inches (about 254 mm).

12. The method claimed in claim 3 for casting aluminum alloy having a low alloy content, characterized by the further step of:

predetermining said maximum acceptable value for said deviation to be about 0.010 of an inch (about 0.25 mm) for casting such aluminum alloy having a low alloy content.

13. The method claimed in claim 3 for casting aluminum alloy containing at least abut 2.5 percent by weight of magnesium and thereby having a "long-freezing range", characterized by the further step of:

predetermining said maximum acceptable value for said deviation to be about 0.005 of an inch (about 0.13 mm) for casting aluminum alloy having such long freezing range.

14. The method as claimed in claim 12, characterized by the further steps of:

initially testing the casting belt by revolving the tensed casting belt prior to introducing molten aluminum alloy into the moving mold and determining deviation of the front face of the revolving casting belt relative to said predetermined "pass line", and avoiding use of the casting belt for continuous casting until after the belt has been subjected to flattening if the initial testing reveals deviations exceeding said maximum acceptable value.

15. The method as claimed in claim 13 characterized by the further steps of:

initially testing the casting belt by revolving the tensed casting belt prior to introducing molten aluminum alloy into the moving mold and determining continual deviation of the front face of the revolving casting belt relative to said predetermined "pass line", and avoiding use of the casting belt for continuous casting until after the belt has been subjected to flattening if the initial testing reveals deviations exceeding said maximum acceptable value.

16. In preparing for the operation of a twin-belt continuous casting machine wherein two tensed, flexible, steel casting belts are simultaneously revolved, and said casting belts each has a front face and a back face, and said front faces are to be used for defining a moving mold between them as said casting belts are simultaneously revolving, the method of testing each such new casting belt prior to employing the belt for casting, comprising the steps of:

revolving the new casting belt while tensed under a tension of at least about 10,000 pounds per square inch (at least about 700 kilograms per sq. cm.), positioning an eddy-current type of proximity sensor at a predetermined distance from the back face of the revolving, tensed casting belt, using the proximity sensor for sensing variations in spacing between the proximity sensor and the back face of the revolving casting belt, determining whether there is any variation in spacing at least as great as a critical value of about 0.008 of an inch (about 0.2 mm), in the absence of any variation amounting to such critical value, proceeding to employ the new casting belt for continuous casting in a twin-belt machine, and with the occurrence of any variation of such critical value, proceeding to subject the new casting belt to a levelling operation prior to employing the new casting belt for continuous casting in a twin-belt casting machine.

17. In preparing for the operation of a twin-belt casting machine, the method of testing claimed in claim 16, in which:

the proximity sensor is positioned at a predetermined distance in the range of about 0.08 of an inch (about 2 mm) to about 0.40 of an inch (about 10.2 mm) from the back face of the revolving, tensed casting belt.

18. In the continuous casting of metal product from molten metal employing a movable mold including two revolvable tensed, flexible, electrically-conductive metallic casting belts each having a front face and wherein said casting belts are simultaneously revolved for defining opposite sides of the mold located between the revolving belts each of said belts having a predetermined desired "pass line" position, and said casting belt having back face cooled by aqueous coolant applied to said back face in the vicinity of the mold, and wherein at the start of continuous casting molten metal is introduced into an entrance of the movable mold with movable "dummy bar" temporarily resting between the belts at a distance downstream from said entrance, the method of initiating continuous casting operation comprising the steps of:

positioning a proximity sensor in predetermined spaced relationship relative to the back face of at least one casting belt, said proximity sensor being positioned in a region opposite to the mold at a position intermediate said entrance and said dummy bar, temporarily keeping both belts stationary for retaining said dummy bar stationary, using the proximity sensor for sensing the spacing between the back face of the casting belt and said proximity sensor, introducing molten metal into said entrance flowing downstream in the mold toward said dummy bar, and upon sensing a sudden increase in said spacing between the back face of the casting belt and the proximity sensor, starting simultaneous revolving motion of both of said belts for beginning movement of the two-belt mold carrying the dummy bar downstream ahead of the molten metal.

19. The method claimed in claim 18, characterized further in that:

said proximity sensor is positioned downstream from a point of first contact of molten metal with said one casting belt at a distance of no more than about ten inches (about 254 mm).

20. The method claimed in claim 18, characterized in that:

said proximity sensor is positioned spaced about 0.08 of an inch (about 2 mm) to about 0.40 of an inch (about 10.2 mm) from said back face.

21. The method claimed in claim 19, characterized further in that:

said proximity sensor is positioned spaced about 0.08 of an inch (about 2 mm) to about 0.40 of an inch (about 10.2 mm) from said back face.

22. In a twin-belt continuous casting machine wherein two tensed, flexible, electrically conductive casting belts are simultaneously revolved, and each of said casting belts has a front face and a back face, and said front faces are used for defining a moving mold between them as said casting belts are simultaneously revolving, and each of said belts is desired to follow a predetermined "pass line" during continuous casting, apparatus for monitoring characteristics of the front face of at least one of said casting belts as said one belt is revolving during continuous casting, said apparatus comprising:

an eddy-current type of proximity sensor, mounting means holding said proximity sensor in predetermined spaced relationship relative to the back face of said one belt as it is revolving during casting, said mounting means holding said proximity sensor in a region where said one belt is desired to move along said "pass line", energizing means for energizing said proximity sensor with an alternating current, and means for determining variations in the spacing between said proximity sensor and said back face of the revolving casting belt for determining deviations of the revolving casting belt from sad "pass line".

23. In a twin-belt continuous casting machine, the apparatus claimed in claim 22, wherein:

said mounting means holds said proximity sensor about 0.08 of an inch (about 2 mm) to about 0.04 of an inch (about 10.2 mm) from said back face.

24. In a twin-belt continuous casting machine, the apparatus claimed in claim 22, wherein:

said mounting means holds said proximity sensor downstream from a point of first contact of molten metal with the front face of the casting belt at a distance no more than about 10 inches (about 254 mm) from said point of first contact.

25. In a twin-belt continuous casting machine, the apparatus claimed in claim 23, wherein:

said mounting means holds said proximity sensor downstream from a point of first contact of molten metal with the front face of the casting belt at a distance no more than about 10 inches (about 254 mm) from said point of first contact.

26. In a twin-belt continuous casting machine wherein two tensed, flexible, electrically conductive casting belts are simultaneously revolved by drive means during continuous casting, and each of said casting belts has a front face and a back face, and said front faces are used for defining a mold between them, said mold moving downstream as said casting belts are simultaneously revolving, and wherein at the start of continuous casting said belts are temporarily stationary and molten metal is introduced into an entrance of the mold with a movable "dummy bar" temporarily resting between the stationary belts at a distance downstream from said entrance, apparatus for automatically starting operation of said drive means for commencing simultaneous revolving motion of said belts at commencement of a continuous casting operation, said apparatus comprising:

an eddy-current type of proximity sensor, mounting means holding said proximity sensor in predetermined spaced relationship relative to the back face of a stationary casting belt prior to commencement of continuous casting, said mounting means holding said proximity sensor in a region near said mold, said sensor being located downstream from said entrance and upstream from said dummy bar, energizing means for energizing said proximity sensor with alternating current, means for introducing molten metal into said entrance for flowing molten metal downstream in said mold, said molten metal flowing toward said dummy bar, sensing means responsive to change in spacing between said proximity sensor and the back of the stationery belt, and start-up control means connected to said drive means and being responsive to said sensing means for starting said drive means for commencing simultaneous revolving motion of said belts for moving said mold and said dummy bar downstream upon occurrence of a sudden change in spacing between said proximity sensor and the back of the stationary belt due to deflection of the belt caused by introduction of molten metal into the mold.

27. In a twin-belt continuous casting machine, apparatus for automatically starting operation of said drive means claimed in claim 26, including:

adjustable time-delay means associated with said start-up control means for adjusting a time-delay between occurrence of said sudden change in spacing and the starting of said drive means.

28. In a twin-belt continuous casting machine, apparatus for automatically starting operation of said drive means claimed in claim 26, wherein:

said start-up control means has a threshold value which is exceeded before the starting of said drive means.

29. In a twin-belt continuous casting machine, apparatus for automatically starting operation of said drive means claimed in claim 28, in which:

said threshold value is a sensed change in spacing of at least about 0.005 of an inch (about 0.13 mm).

30. In a twin-belt continuous casting machine, apparatus for automatically starting operation of said drive means claimed in claim 27, wherein:

said start-up control means has a threshold value which is exceeded before the starting of said drive means.

31. In a twin-belt continuous casting machine, apparatus for automatically starting operation of said drive means claimed in claim 30, in which:

said threshold value is a sensed change in spacing of at least about 0.005 of an inch (about 0.13 mm).

* * * * *